US007229106B2

(12) United States Patent
Bassett et al.

(10) Patent No.: US 7,229,106 B2
(45) Date of Patent: Jun. 12, 2007

(54) LATCH

(75) Inventors: Raymond C. Bassett, Webster, NY (US); Gary A. Nobles, Mendon, NY (US)

(73) Assignee: Xerox Corporation, Stamford, CT (US)

( * ) Notice: Subject to any disclaimer, the term of this patent is extended or adjusted under 35 U.S.C. 154(b) by 197 days.

(21) Appl. No.: 11/191,481

(22) Filed: Jul. 27, 2005

(65) Prior Publication Data

US 2007/0022891 A1 Feb. 1, 2007

(51) Int. Cl.
*E05C 3/04* (2006.01)
*B41J 2/14* (2006.01)

(52) U.S. Cl. ..... 292/207; 347/49

(58) Field of Classification Search ..... 292/207, 292/106, 122, 128, 100, 102, 228, 203; 101/479; 347/49

See application file for complete search history.

(56) References Cited

U.S. PATENT DOCUMENTS 2,153,819 A * 4/1939 Van Voorhees ..... 292/164
2,647,003 A * 7/1953 Way ..... 292/128
3,152,826 A * 10/1964 Smith ..... 292/341.16
3,876,317 A 4/1975 Jordan
4,123,734 A 10/1978 Maier et al.
4,295,732 A 10/1981 Hull
4,515,468 A 5/1985 Taylor et al.
4,989,035 A 1/1991 Leonhart
5,157,448 A 10/1992 Lang
5,216,246 A 6/1993 Weldman et al.
5,583,612 A 12/1996 Schell et al.
5,767,977 A 6/1998 Thelen et al.
5,926,671 A 7/1999 Leibman
6,032,004 A 2/2000 Mirabella, Jr. et al.
6,699,128 B1 * 3/2004 Beadell et al. ..... 463/46
2004/0095416 A1 * 5/2004 Chang ..... 347/29
2005/0052032 A1 3/2005 Ilea et al.
2005/0140151 A1 6/2005 Egi et al.

* cited by examiner

*Primary Examiner*—Gary Estremsky
(74) *Attorney, Agent, or Firm*—Gibb & Rahman, LLC

(57) ABSTRACT

In embodiments herein a latch apparatus comprises a striker plate and a latch. The latch comprises a pin that is positioned to contact the inclined surface of the striker plate as the latch moves over the striker plate. The latch also comprises a roller that is positioned to roll over a lip of the striker plate as the latch moves over the striker plate. In addition, an arm is operatively connected to the roller. The arm pivots when the roller moves. The pin locks the arm and prevents the roller from moving when the pin is in the lowered position and the pin allows the arm to pivot and allows the roller to move when the pin is in the raised position.

20 Claims, 5 Drawing Sheets

LATCH

BACKGROUND

It is common for mechanical devices to utilize doors and/or drawers that can be opened by the user. Such doors/drawers need to utilize latches to remain closed after the user has performed the desired operation and closed the door/drawer. One issue is that the latches may not maintain a consistent position of the door/drawer. In addition, the mechanical pieces that hold the latch in position often experience high frictional contact surfaces between the various components. For example, in FIG. 3 of U.S. Pat. No. 6,032,004 (the complete disclosure of which is fully incorporated herein by reference) a catch rests against a latch to lock the latch mechanism. However, a large amount of friction exists between the catch and the latch. These high frictional surfaces require a large amount of force (or a highly powered actuator) in order to allow the latch mechanism to release. However, it is desirable to provide a latch that opens with very little force and that maintains an accurate closed position within a very small movement tolerance.

SUMMARY

Embodiments herein comprise a latch apparatus. The latch apparatus can be used, for example, to lock a drawer, door, or any other opening structure. In examples herein the latch is used in a printing apparatus that may include a body, a printing engine, and a drawer, door, etc. that is locked closed with a latch.

In embodiments herein the latch apparatus comprises a striker plate and a latch. The striker plate comprises an inclined surface; a top at the end of the inclined surface; an edge at the end of the top of the striker plate; and a lip on the top of the striker plate. The latch contacts and moves over the striker plate. More specifically, the latch comprises a frame, a pin that is operatively connected to the frame and positioned to contact the inclined surface of the striker plate as the latch moves over the striker plate. The latch also comprises a roller that is operatively connected to the frame and positioned to roll over the lip as the latch moves over the striker plate. The roller moves in a first plane parallel to the top of the striker plate when rolling over the lip. In addition, an arm is operatively connected to the roller. The arm pivots when the roller moves in the first plane. An actuator is operatively connected to the pin. The actuator moves the pin in a second plane, perpendicular to the top of the striker plate, from a lowered position to a raised position when activated.

The pin is positioned to move in the second plane from the lowered position to the raised position as the pin moves up the inclined surface of the striker plate, and to move back into the lowered position as the pin moves past the edge of the top of the striker plate. The pin locks the arm and prevents the roller from moving in the first plane when the pin is in the lowered position and the pin allows the arm to pivot (and allows the roller to move in the first plane) when the pin is in the raised position.

The pin comprises a cylinder having an upper portion having a first diameter and a lower portion having a second diameter smaller than the first diameter. The arm comprises an opening having a shape that matches the cross-section of the pin (which can be circular, oval, rectangular, etc.) having a third diameter that is larger than the first diameter. The third diameter of the opening allows both the upper and lower portions of the pin to pass through the arm. A slot is formed into the arm extending from the circular opening. The slot and opening form a continuous opening in the arm. The slot has a width that is smaller than the first diameter and is larger than the second diameter. Therefore, only the lower portion of the pin will fit in the slot. Thus, when the pin is in the lowered position, it rests in the opening and, because the slot is more narrow than the upper portion of the pin, the arm is fixed in position and cannot pivot. This prevents the roller from moving back over the lip and locks the latch and the drawer/door closed.

The lip is positioned at one side of the top of the inclined surface. The surface of the lip that contacts the roller is perpendicular to the top of the striker plate. Thus, the outer rounded surface of the roller is perpendicular to the surface of the top of the striker. The roller has an axle that is parallel to the pin, which is also perpendicular to the top surface of the striker. A biasing member, such as a spring, etc., is operatively connected to the roller and biases the roller against the lip. These and other features are described in, or are apparent from, the following detailed description.

BRIEF DESCRIPTION OF THE DRAWINGS

Various exemplary embodiments are described in detail below, with reference to the attached drawing figures, in which.

DETAILED DESCRIPTION

As mentioned above, it is desirable to provide a latch that opens with very little force and that maintains an accurate closed position within very small movement tolerances. The embodiments described below provide a latch apparatus that maintains the position of the latch within very small tolerances, yet requires very small forces to release the latch. The embodiments herein accomplish this combination of features by separating the latch locking mechanism from the mechanism utilized to maintain the position of the latch with respect to the striker plate.

Figure 1:
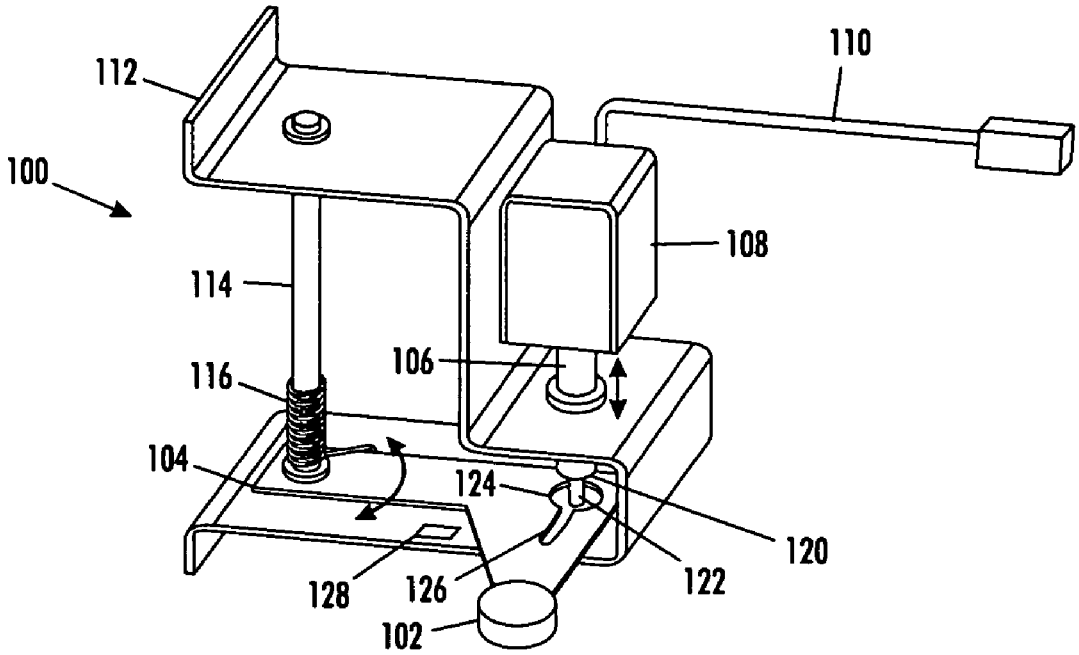
FIG. 1 is a schematic perspective representation of a latch assembly according to embodiments herein.
Figure 8:
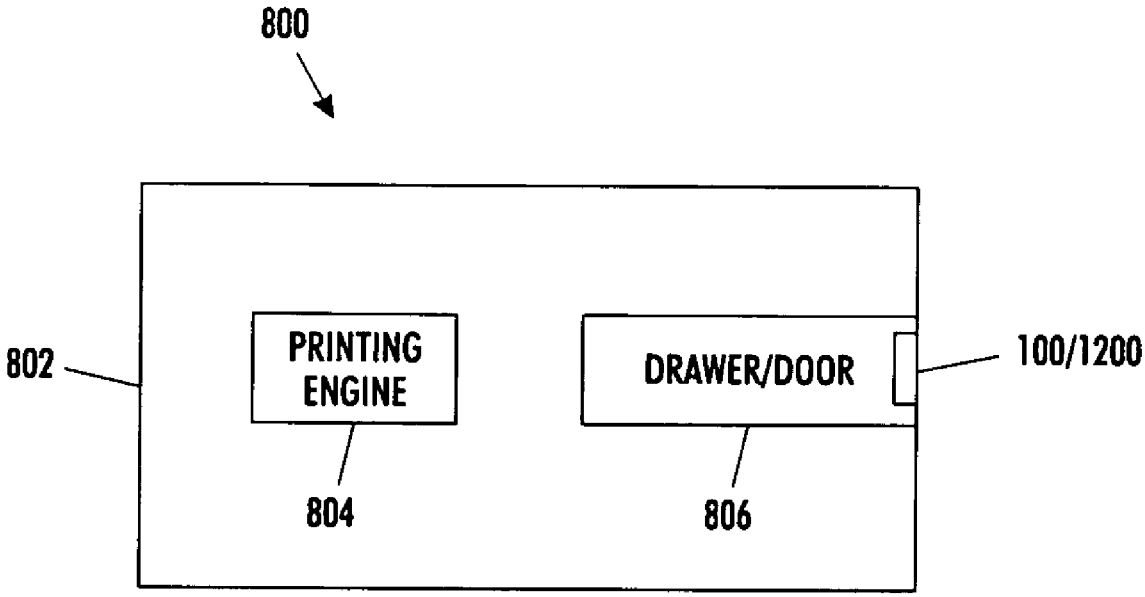
FIG. 8 is a schematic representation of a printer apparatus according to embodiments herein.

More specifically, as shown in FIGS. 1 and 8, embodiments herein utilize a roller 102 within a latch mechanism 100 that rests against a cam or lip 202 of a striker plate 200 in order to maintain the position of the latch with respect to the striker plate 200. A separate assembly comprising an arm 104 and a pin 106 is utilized to lock the roller 102 in position. By separating the structure and that maintains positional accuracy from the structure that locks the latch mechanism, the embodiments herein provide a latch apparatus that maintains the position of the latch within very small tolerances, yet requires very small forces to release the latch.

The cam or lip 202 can be formed to include a very steep latch angle (in region 204 past the peak of the lip 202), so that the tolerances between the drawer/door and the body of the device can be maintain with high accuracy. Further, because the pin 106 and arm 104 used to lock the latch mechanism are a separate assembly, the arm 104 is positioned such that it exerts little or no force on the pin 106. Therefore, the pin 106 can be lifted using a very small actuator/solenoid 108.

Figure 2:
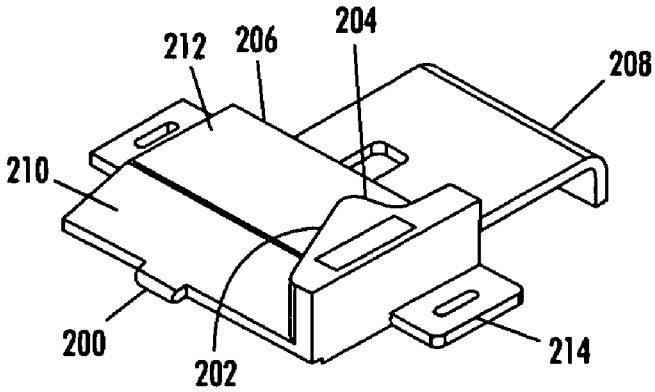
FIG. 2 is a schematic perspective representation of a striker plate according to embodiments herein.
Figure 3:
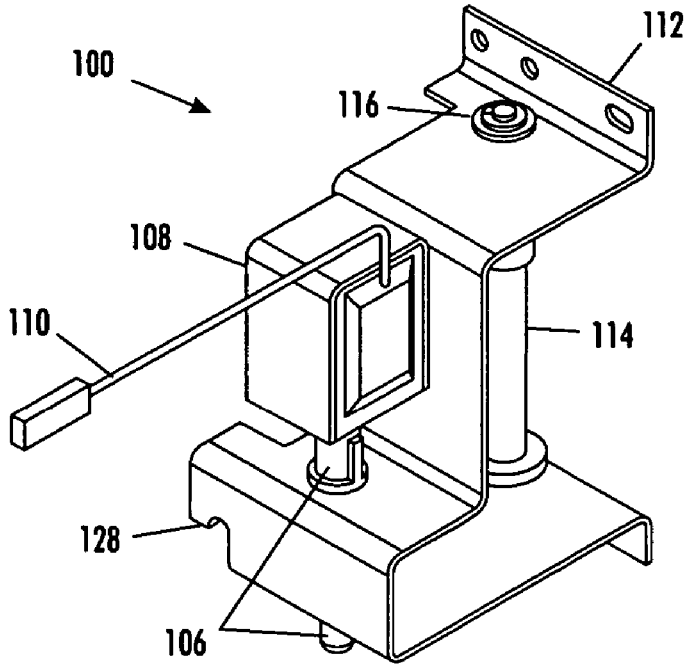
FIG. 3 is a schematic perspective representation of a latch assembly according to embodiments herein.
Figure 4:
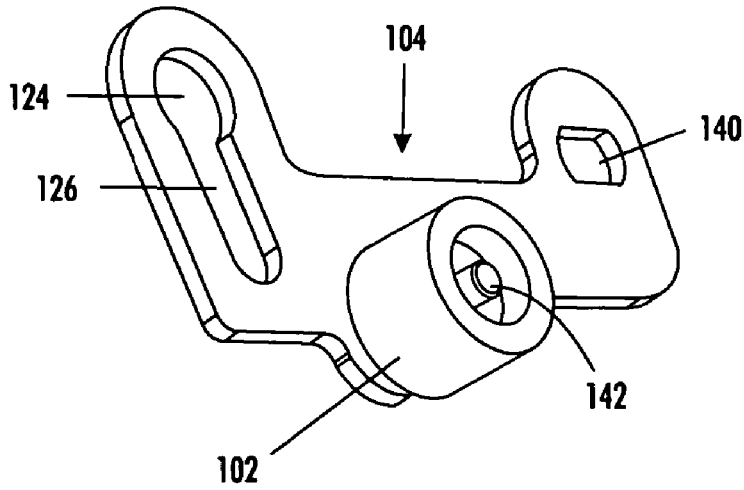
FIG. 4 is a schematic representation of an arm according to embodiments herein.
Figure 5:
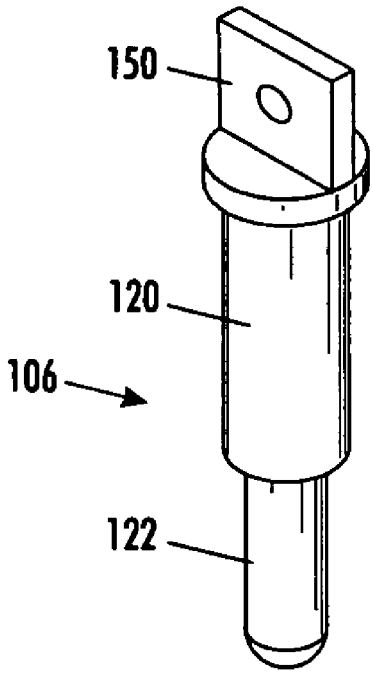
FIG. 5 is a schematic representation of a pin according to embodiments herein.

In the drawings, FIGS. 1 and 3 are perspective drawings of different sides of the same latch assembly 100. FIG. 2 illustrates the striker plate assembly 200. FIG. 8 illustrates the latch assembly 100 over the striker plate 200. FIG. 4 illustrates the arm 104 in detail and FIG. 5 illustrates the pin 106 in detail.

The latch mechanism 100 includes a frame 112 which is illustrated in FIGS. 1 and 3 as being a shaped member. The shape of the frame 112 shown in the attached drawings is only one example used to illustrate the features of embodiments herein. As would be understood by one ordinarily skilled in the art in light of this disclosure, any frame shape could be utilized with embodiments herein, depending upon specific design requirements and physical constraints of the device in which the latch is being utilized. The frame 112 as well as the remaining elements of the latch mechanism 100 and striker plate 200 can be made of any appropriate material, including metal, alloys, rubber, plastic, ceramic, and similar materials, as well as any combination of such materials.

Figure 6:
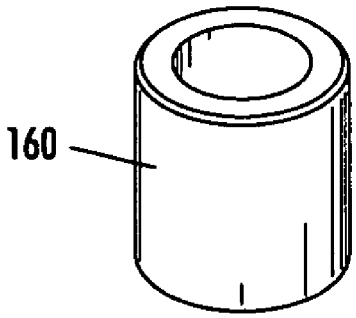
FIG. 6 is a schematic representation of a spacer according to embodiments herein.

A pivot rod 114 is attached to the frame 112 and supports the arm 104 through a pivot opening 140 (FIG. 4). The arm 104 pivots around the pivot rod 114. As shown in FIGS. 1 and 4, the roller 102 freely rotates on an axle 142 that is connected to the arm 104. The arm 104 is biased using some form of biasing member. In the example shown in FIGS. 1 and 3, a spring 116 is utilized to bias the arm 104 in a direction to make the roller 102 press into the region 204 past the peak of the lip 202 and press against the remaining portions of the lip 202 and is the roller 102 moves over the lip 202. While a spring 116 is illustrated in drawings, one ordinarily skilled in the art would understand that any form of biasing member, such as a flexible bar elastic band, etc. can be used to bias the arm 104. If desired, a spacer, such a spacer 160 shown in FIG. 6, can be positioned around the pin 106 to prevent the arm 104 from rising, thereby maintaining the arm 104 essentially parallel to the frame 112 through manufacturing and operating conditions.

The pin 106 comprises a cylinder having an upper portion 120 having a first diameter and a lower portion 122 having a second diameter smaller than the first diameter. The arm comprises an opening 124 (which can be circular, oval, etc.) having a third diameter that is larger than the first diameter. The third diameter of the opening 124 allows both the upper 120 and lower 122 portions of the pin 106 to pass through the opening 124 in the arm 104. A slot 126 extends from the opening 124 and the slot 126 is aligned with the lower portion 122 of the pin 106 such that when the arm 104 pivots inward, the slot moves past the lower portion 122 of the pin 106. The slot 126 and opening 124 form a continuous opening in the arm.

The slot 126 has a width that is smaller than the first diameter and is larger than the second diameter. Therefore, only the lower portion 122 of the pin 106 will fit in the slot 126. Thus, when the pin 106 is in the lowered position, it rests in the opening 124 and, because the slot 126 is narrower than the upper portion 120 of the pin 106, the arm 104 is fixed in position and cannot pivot when the pin 106 is lowered. This locks the roller 102 against the steep portion 204 of the lip 202 and maintains high positional accuracy between the latch 100 and the striker plate 200.

The frame 112 includes a stop member 128 that is attached to, or formed from the frame 112. The stop member 128 is positioned to prevent the arm 104 from moving beyond a location that would allow the pin 106 to easily move within the larger opening 124 within the arm 104. Thus, unless other forces are exerted on the arm 104 and/or roller 102, the force of the biasing member 116 holds the arm 104 against the stop member 128 in a position where the opening 124 is aligned with the pin 106. In this aligned position, the pin 106 may not touch any portion of the opening 124 or, if the pin 106 does touch portions of the opening 124, the frictional forces between the opening 124 and the pin 106 are insignificant when compared to the weight of the pin 106, and the primary force required to lift the pin 106 is essentially equivalent to only the weight of the pin 106. In FIG. 1, the stop member 128 is illustrated as a raised portion of the frame while in FIGS. 3 and 7, the stop member 128 is illustrated as a bent member of a corner of the frame. One ordinarily skilled in the art would understand that any similar structures can be utilized as the stop member 128.

In some embodiments herein item 108 comprises an actuator and item 110 comprises wiring connected to the actuator 108. In some embodiments, when energized, the actuator 108 lifts the pin 106 and when de-energized, the actuator 108 allows the pin 106 to fall (relying upon gravitational forces). Alternatively, the actuator 108 may comprise a two-way actuator that forces the pin 106 up and down. As shown in FIG. 5, the pin 106 includes a connection 150 to the actuator 108.

In alternative embodiments, item 108 can represent a gearbox, levers, or other similar purely mechanical device adapted to translate horizontal movement into vertical movement. In such embodiments, item 110 represents a bar or linkage attached to an external handle, wherein upon pulling the handle and moving the linkage 110, the movement of the bar 110 is translated into vertical movement of the pin 106 by the gearbox 108. Such embodiments would eliminate the need for a powered actuator/solenoid 108.

Regardless of the type of the actuator (or mechanical linkage) utilized to raise/lower the pin 106, because the pin 106 experiences no frictional forces (or extremely reduced frictional forces) from the opening 124, the size of the actuator (and/or force required from the mechanical linkage) only needs to overcome approximately just the weight of the pin 106. Again, this is because the frictional forces exerted by the opening 124 against the pin 106 are insignificant when considered against the weight of the pin 106 (e.g., frictional forces are less than approximately 10%, 5%, 2%, etc. of the weight of the pin). This is contrasted to U.S. Pat. No. 6,032,004 where the majority of the forces required to release the latch are used to overcome the frictional forces between the catch and latch.

The striker plate 200 comprises an inclined surface 210; a flat planar top 212 at the end of the inclined surface 210; a back edge 206 at the end of the top 212 of the striker plate that is opposite the inclined surface 210; the lip 202 on the top of the striker plate 212; attachment flanges 214; and a support frame/adjustment handle 208. The striker plate 200 can be molded from a single piece of material or can be formed from separate components connected together. Item 4 in FIG. 2 represents the position of a label. The inclined surface 210 must lift feature 120 above opening 124 before 102 touches 202. The top of the striker plate 212 is approximately parallel to the lower portion of the frame 112 of the latch 100. The back edge 206 of the top 212 is an approximate right angle such that the surface drops straight to the frame member 208.

Figure 7:
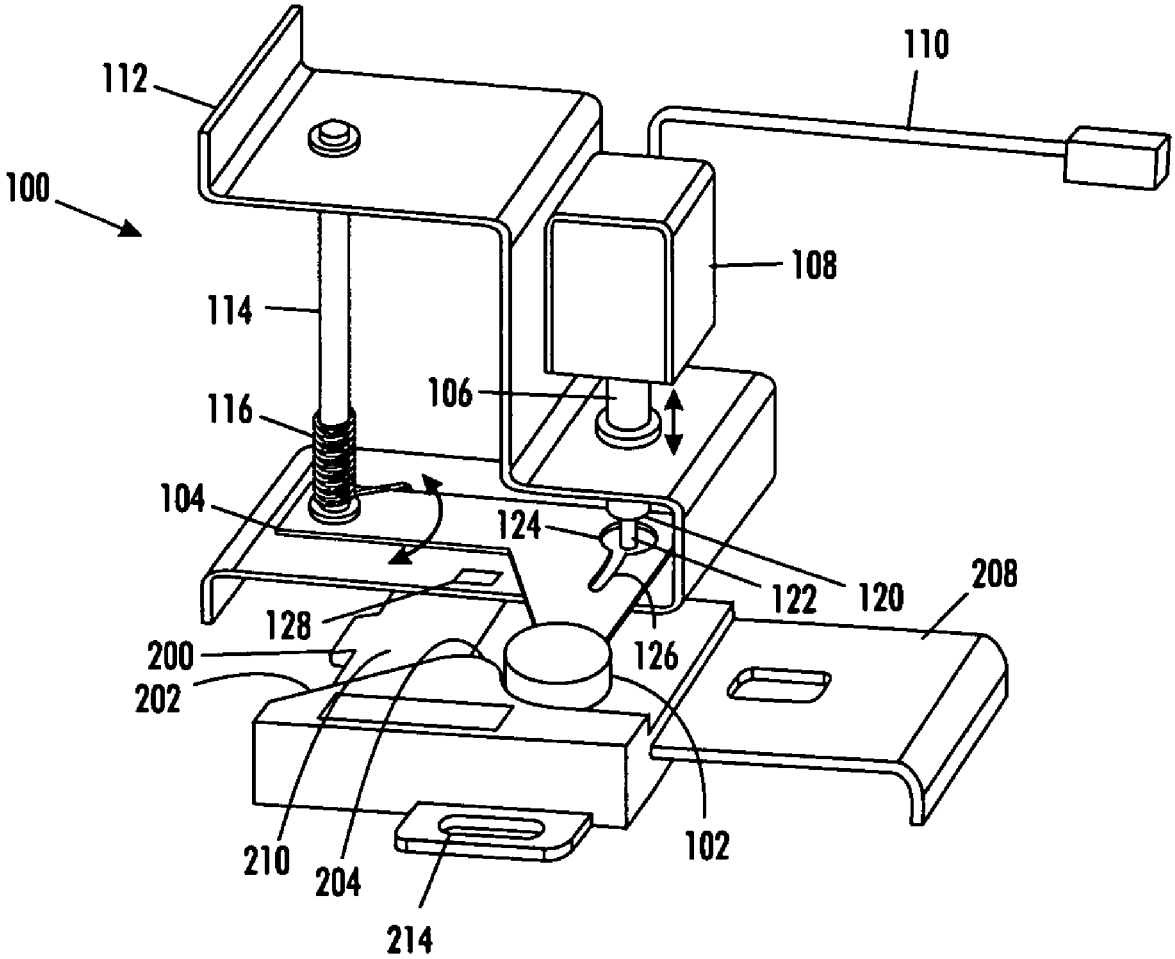
FIG. 7 is a schematic perspective representation of a latch assembly over a striker plate according to embodiments herein.

The latch 100 contacts and moves over the striker plate 200 as the drawer/door opens and closes, as shown in FIG. 7. Thus, either the latch 100 or the striker plate 200 is connected to the door/drawer and the other of the two structures is connected to the body of an apparatus, such that when the door or drawer is closed, the latch 100 is positioned directly over the striker plate 200. This positioning of the latch 100 and the striker plate 200 locks the position of the door/drawer when the door/drawer is closed.

The pin 106 is positioned to contact the inclined surface 210 of the striker plate as the latch 100 moves over the striker plate 200. The outer surface of the roller 102 is positioned perpendicular to the and top of the striker plate 212 so as to allow the roller 102 to roll over the lip as the latch 100 moves over the striker plate 200. The roller 102 moves in a first plane parallel to the top of the striker plate 212 when rolling over the lip. In addition, the arm 104 pivots in the first plane against the biasing member 116 when the roller 102 moves in the first plane. The actuator 108 moves the pin 106 in a second plane, perpendicular to the top of the striker plate 212, from a lowered position to a raised position when activated.

The pin 106 is positioned to move in the second plane from the lowered position to the raised position as the pin 106 moves up the inclined surface 210 of the striker plate, and to drop back into the lowered position as the pin 106 moves past the back edge 206 of the top of the striker plate 212. The pin 106 locks the arm 104 and prevents the roller 102 from moving in the first plane when the pin 106 is in the lowered position and the pin 106 allows the arm to pivot and allows the roller 102 to move in the first plane when the pin 106 is in the raised position.

The lip is positioned at one side of the top of the inclined surface 210. The surface of the lip that contacts the roller 102 is perpendicular to the top of the striker plate 212. Thus, the outer rounded surface of the roller 102 (e.g., the surface of the roller 102 that rolls along the surface of the lip 202) is perpendicular to the surface of the top of the striker. The axle 142 of the roller 102 is parallel to the pin 106, which is also perpendicular to the top surface of the striker plate 212.

When transitioning from the locked position to the unlocked position, the actuator 108 is energized and causes the pin 106 to be lifted, so that the arm 104 can rotate. As mentioned above, the smaller diameter of the lower portion 122 of pin 106 allows the arm 104 to move. As the drawer/door is pulled open by the user, the roller 102 rolls up the steep side 204 of the lip 202, which causes the arm 104 to rotate and push against the biasing member 116. As the arm 104 rotates, the slot 126 moves by the pin 106. The arm 104 is biased in the direction that causes the roller 102 to rests against the lip. However, as the user pulls the drawer/door open, the roller 102 rolls along the back edge 204 of the lip, thereby causing the arm to rotate. Again, the arm will not rotate if the pin 106 is in the lower position, because the slot cannot move by the larger diameter upper portion of the pin when the pin 106 is in the lowered position. Thus, the user would not be able to open the drawer/door unless the pin 106 is in the raised position by operation of the actuator 108. Otherwise, the roller 102 stays fixed against the lip 202 and prevents the drawer/door from opening.

The actuator 108 stays energized until software senses that the drawer/door is open (through well-known drawer interlock mechanisms, e.g., see U.S. Pat. No. 5,216,246 the disclosure of which is fully incorporated herein by reference). After a time delay, the actuator is de-energized and the pin 106 falls into the opening, thereby again locking the arm.

When transitioning from the unlocked positioned to the locked position (when closing the drawer/door), as the drawer/door is pushed closed by the user, the bottom tip of the pin 106 contacts the inclined plane 210 of the striker plate 200 and lifts the pin before the roller 102 is pushed in by the lip 202 causing 104 to rotate. As the latch 100 continues to move over the striker plate 200, the pin 106 reaches the back edge 206 of the top surface of the 212 of the striker plate 200 and drops over the edge 206. When the pin drops over the edge 206 of the striker plate 200, the pin 106 falls into the opening 124 of the arm 104, thereby locking the arm 104 and locking the roller 102 against the steep portion 204 of the lip 202. The size of the top of the striker plate 212 and the position of the pin 106 and roller 102 are designed so that the pin 106 stays in the raised position long enough to allow the roller 102 to roll over the lip 202. The actuator does not need to be activated when closing the drawer/door as the inclined plane lifts the pin 106 to allow the arm 104 to unlock.

The latch apparatus can be used, for example, to lock a drawer, door, or any other opening structure. In some embodiments herein, the latch is used in a printing apparatus 800 that may include a body 802, a printing engine 804, and a drawer, door, etc. 806, that is locked closed with the latch 100/200, as shown in FIG. 8. The word "printer" and "printing apparatus" as used herein encompasses any apparatus, such as a digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus comprising:

a striker plate comprising: an inclined surface; a top at an end of said inclined surface; an edge at an end of said top of said striker plate; and a lip on said top of said striker plate; and a latch adapted to contact and move over said striker plate, wherein said latch comprises:

a frame;

a pin operatively connected to said frame and positioned to contact said inclined surface of said striker plate as said latch moves over said striker plate; and a roller operatively connected to said frame and positioned to roll over said lip as said latch moves over said striker plate, wherein said roller moves in a first plane parallel to said top of said striker plate when rolling over said lip, wherein said pin is positioned to move in a second plane, perpendicular to said top of said striker plate, from a lowered position to a raised position as said pin moves up said inclined surface of said striker plate, and to move back into said lowered position as said pin moves past said edge of said top of said striker plate, and wherein said pin prevents said roller from moving in said first plane when said pin is in said lowered position.

2. The apparatus according to claim 1, wherein said lip is positioned at one side of said top of said inclined surface.

3. The apparatus according to claim 1, wherein said roller includes an axle that is parallel to said pin.

4. The apparatus according to claim 1, wherein a surface of said lip that contacts said roller is perpendicular to said top of said striker plate.

5. The apparatus according to claim 1, further comprising a biasing member operatively connected to said roller that biases said roller against said lip.

6. An apparatus comprising:

a striker plate comprising: an inclined surface; a top at an end of said inclined surface; an edge at an end of said top of said striker plate; and a lip on said top of said striker plate; and a latch adapted to contact and move over said striker plate, wherein said latch comprises:

a frame;

a pin operatively connected to said frame and positioned to contact said inclined surface of said striker plate as said latch moves over said striker plate;

a roller operatively connected to said frame and positioned to roll over said lip as said latch moves over said striker plate, wherein said roller moves in a first plane parallel to said top of said striker plate when rolling over said lip;

an arm operatively connected to said roller, wherein said arm pivots in said first plane when said roller moves in said first plane; and an actuator operatively connected to said pin, wherein said actuator moves said pin in a second plane, perpendicular to said top of said striker plate, from a lowered position to a raised position when activated, wherein said pin is positioned to move in said second plane from said lowered position to said raised position as said pin moves up said inclined surface of said striker plate, and to move back into said lowered position as said pin moves past said edge of said top of said striker plate, and wherein said pin locks said arm and prevents said roller from moving in said first plane when said pin is in said lowered position; and said pin allows said arm to pivot and allows said roller to move in said first plane when said pin is in said raised position.

7. The apparatus according to claim 6, wherein said pin comprises an upper portion having a first diameter and a lower portion having a second diameter smaller than said first diameter.

8. The apparatus according to claim 6, wherein said lip is positioned at one side of said top of said inclined surface.

9. The apparatus according to claim 6, wherein said roller includes an axle that is parallel to said pin.

10. The apparatus according to claim 6, wherein a surface of said lip that contacts said roller is perpendicular to said top of said striker plate.

11. A printer apparatus comprising:

a body;

a printing engine operatively connected to said body;

a drawer operatively connected to said body; and a latch apparatus operatively connected to said body and said drawer, wherein said latch apparatus comprises:

a striker plate comprising: an inclined surface; a top at an end of said inclined surface; an edge at an end of said top of said striker plate; and a lip on said top of said striker plate; and a latch adapted to contact and move over said striker plate, wherein said latch comprises:

a frame;

a pin operatively connected to said frame and positioned to contact said inclined surface of said striker plate as said latch moves over said striker plate; and a roller operatively connected to said frame and positioned to roll over said lip as said latch moves over said striker plate, wherein said roller moves in a first plane parallel to said top of said striker plate when rolling over said lip, wherein said pin is positioned to move in a second plane, perpendicular to said top of said striker plate, from a lowered position to a raised position as said pin moves up said inclined surface of said striker plate, and to move back into said lowered position as said pin moves past said edge of said top of said striker plate, and wherein said pin prevents said roller from moving in said first plane when said pin is in said lowered position.

12. The printer apparatus according to claim 11, wherein said lip is positioned at one side of said top of said inclined surface.

13. The printer apparatus according to claim 11, wherein said roller includes an axle that is parallel to said pin.

14. The printer apparatus according to claim 11, wherein a surface of said lip that contacts said roller is perpendicular to said top of said striker plate.

15. The printer apparatus according to claim 11, wherein said printer comprises at least one of an electrostatographic and a xerographic machine and process.

16. A module installable in an apparatus, said module comprising:

a striker plate comprising: an inclined surface; a top at an end of said inclined surface; an edge at an end of said top of said striker plate; and a lip on said top of said striker plate; and a latch adapted to contact and move over said striker plate, wherein said latch comprises:

a frame;

a pin operatively connected to said frame and positioned to contact said inclined surface of said striker plate as said latch moves over said striker plate; and a roller operatively connected to said frame and positioned to roll over said lip as said latch moves over said striker plate, wherein said roller moves in a first plane parallel to said top of said striker plate when rolling over said lip, wherein said pin is positioned to move in a second plane, perpendicular to said top of said striker plate, from a lowered position to a raised position as said pin moves up said inclined surface of said striker plate, and to move back into said lowered position as said pin moves past said edge of said top of said striker plate, and wherein said pin prevents said roller from moving in said first plane when said pin is in said lowered position.

17. The module apparatus according to claim 16, wherein said lip is positioned at one side of said top of said inclined surface.

18. The module apparatus according to claim 16, wherein said roller includes an axle that is parallel to said pin.

19. The module apparatus according to claim 16, wherein a surface of said lip that contacts said roller is perpendicular to said top of said striker plate.

20. The module apparatus according to claim 16, further comprising a biasing member operatively connected to said roller that biases said roller against said lip.

* * * * *